US006741028B2

(12) United States Patent
Tanabe et al.

(10) Patent No.: US 6,741,028 B2
(45) Date of Patent: May 25, 2004

(54) EL ELEMENT WITH DIELECTRIC INSULATION LAYER

(75) Inventors: Koji Tanabe, Katano (JP); Yosuke Chikahisa, Katano (JP); Naohiro Nishioka, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 81 days.

(21) Appl. No.: 09/986,139

(22) Filed: Nov. 7, 2001

(65) Prior Publication Data

US 2002/0079836 A1 Jun. 27, 2002

(30) Foreign Application Priority Data

Nov. 7, 2000 (JP) ..... 2000-338648

(51) Int. Cl.[7] ..... H05B 33/00
(52) U.S. Cl. ..... 313/509; 313/506
(58) Field of Search ..... 313/503, 504, 313/506, 509, 512, 498; 428/690

(56) References Cited

U.S. PATENT DOCUMENTS 4,440,831 A * 4/1984 Brownlow et al. ..... 252/301.6
4,458,177 A * 7/1984 Hunter et al. ..... 313/506
4,876,481 A 10/1989 Taniguchi et al.
5,055,360 A 10/1991 Ogura et al.
5,068,157 A 11/1991 Won
5,300,858 A 4/1994 Nikaido
5,454,892 A 10/1995 Kardon et al.
5,882,806 A * 3/1999 Mori ..... 313/504
5,985,176 A * 11/1999 Rao ..... 252/301.6
6,479,930 B1 * 11/2002 Tanabe et al. ..... 313/506

FOREIGN PATENT DOCUMENTS

| | | |
|---|---|---|
| EP | 1 168 882 A2 | 1/2002 |
| JP | 05-182765 A | 7/1993 |
| JP | 11-214164 A | 8/1999 |
| JP | 2000-150153 A | 5/2000 |
| KR | 9 401 183 B | 2/1994 |

* cited by examiner

*Primary Examiner*—Ashok Patel
*Assistant Examiner*—Joseph Williams
(74) *Attorney, Agent, or Firm*—McDermott, Will & Emery

(57) ABSTRACT

An EL element comprising: a light transmitting substrate; a light transmitting electrode layer formed on the substrate; a light emitting layer containing a positive ion exchanger; a dielectric layer; a back electrode layer; and a dielectric insulation layer disposed between the light transmitting electrode layer and the light emitting layer. The dielectric insulation layer is formed of a synthetic resin that is insoluble with a synthetic resin binder forming the light emitting layer. The present invention provides an EL element having an improved illuminating performance, where an occurrence of a dark spot is suppressed, in addition to a suppression of an occurrence of a black spot.

5 Claims, 2 Drawing Sheets

EL ELEMENT WITH DIELECTRIC INSULATION LAYER

FIELD OF THE INVENTION

The present invention relates to an EL element used for illuminating display units, operation panels or the like in various kinds of electronic apparatus.

BACKGROUND OF THE INVENTION

EL elements are increasingly used in the sophisticated multi-functional electronic appliances for illuminating the display units and the operation panels. A conventional printing type EL element is described with reference to FIG. 2 and FIG. 3.

FIG. 2 is a cross sectional view of a conventional EL element. The conventional EL element comprises: a transparent insulating film 1 made of polyethylene terephthalate or the like material; a light transmitting electrode layer 2 formed by a sputtering process or an electron beam deposition process covering the whole area of upper surface of the insulating film, or a light transmitting electrode layer 2 formed by printing a transparent synthetic resin containing indium tin oxide or the like material dispersed therein; a light emitting layer 5 formed of a synthetic resin binder 3 containing phosphor 4 of zinc sulfide or the like materials, which emits light, dispersed therein; a dielectric layer 6 of synthetic resin binder containing barium titanate or the like material dispersed therein; a back electrode layer 7 of silver/resin or a carbon/resin composite formed on the dielectric layer 6; and an insulating layer 8 formed of an epoxy resin, polyester resin or the like material. The light emitting layer 5, the dielectric layer 6, the back electrode layer 7 and the insulating layer 8 are overlaid by printing one after the another on the light transmitting electrode layer 2.

An EL element mounted in an electronic appliance is driven by an AC voltage supplied to the light transmitting electrode layer 2 and the back electrode layer 7, the AC voltage is supplied from a circuit of the electronic appliance (not shown). The phosphor 4 contained in the light emitting layer 5 emits light to illuminate display panel, LCD or the like of the appliance from a backside of the display.

When the above-configured EL element emits light in a high humidity environment, a combination of the humidity in the air and the voltage applied sometimes creates a carbonized synthetic resin binder in the synthetic resin binder 3 of light emitting layer 5, which is called a black spot and it impairs the illuminating performance. In order to prevent it, the phosphor 4 of zinc sulfide is generally covered with a moisture barrier layer 4A of metal oxides such as aluminum oxide, titanium oxide, silicon dioxide or the like, and aluminum nitride or the like materials.

In the conventional EL elements, however, if some of phosphors 4 are coagulated with each other when they are treated to be covered with the moisture barrier layer 4A, as shown in FIG. 3(*a*), the boundary portion 9 between the phosphors 4 may be left uncovered by the moisture barrier layer 4A. Or, when a mixture of the phosphors 4 and the synthetic resin binder 3 dissolved in a solvent are stirred, the moisture barrier layer 4A may get damaged as a result of collision between the phosphors 4, and the phosphor 4 may be exposed as illustrated in FIG. 3(*b*). Under such circumstance, there is a problem that the metal ion can elude out from the phosphor 4 in the high humidity environment, which leads to a deteriorated electrical insulation with the light emitting layer 5. Thus the black spot phenomenon readily appears.

To address the above-described problem, the inventors of the present application proposed in the Japanese Patent Application No. 2000-196109 to disperse a positive ion exchanger in the light emitting layer 5, so that the ion eluded out of the phosphor in high humidity environment is captured by the positive ion exchanger contained in light emitting layer. In this way, the light emitting layer maintains good insulating property in the high humidity environment even if covering of the phosphor with the moisture barrier layer is incomplete; thus the black spot becomes difficult to appear.

The above described improved EL element works well in so far as it is used in the portable telephone and the like normal electronic apparatus where the voltage applied is within a range of several volts to twenty volts. However, if it is lit at a high brightness for a long time driven by a high voltage e. g. several tens or one hundred volts, the EL element tends to exhibit a problem, or a so-called dark spot. The dark spot is not seen during OFF time, but when the EL element emits light, some area appears darker than the surrounding area. This area is called a dark spot. The dark spot phenomenon is significant among those EL elements in which the light transmitting electrode layer is formed by a sputtering process and formation of the moisture barrier layer of the phosphor is insufficient.

The present invention aims to address the above problem, and provides an EL element of an improved illuminating property where generation of the dark spot is suppressed, besides the suppression of the black spot.

SUMMARY OF THE INVENTION

An EL element of the present invention comprises: a light transmitting substrate; a light transmitting electrode layer formed on the substrate; a light emitting layer containing positive ion exchanger; a dielectric layer and a back electrode layer. A dielectric insulation layer is further provided, between the light transmitting electrode layer and the light emitting layer, with a dielectric insulation layer being formed of a synthetic resin that is insoluble with the synthetic resin binder forming the light emitting layer.

The present invention provides an EL element of improved illuminating property, with which the generation of the dark spot is well suppressed, besides the suppression of the black spot.

DESCRIPTION OF THE PREFERRED EMBODIMENTS

Exemplary embodiments of the present invention are described with reference to FIG. 1. Those constituent portions having the same structure as those of the conventional EL element are represented with the same numerals, and detailed description of which are eliminated.

First Embodiment

Figure 1:
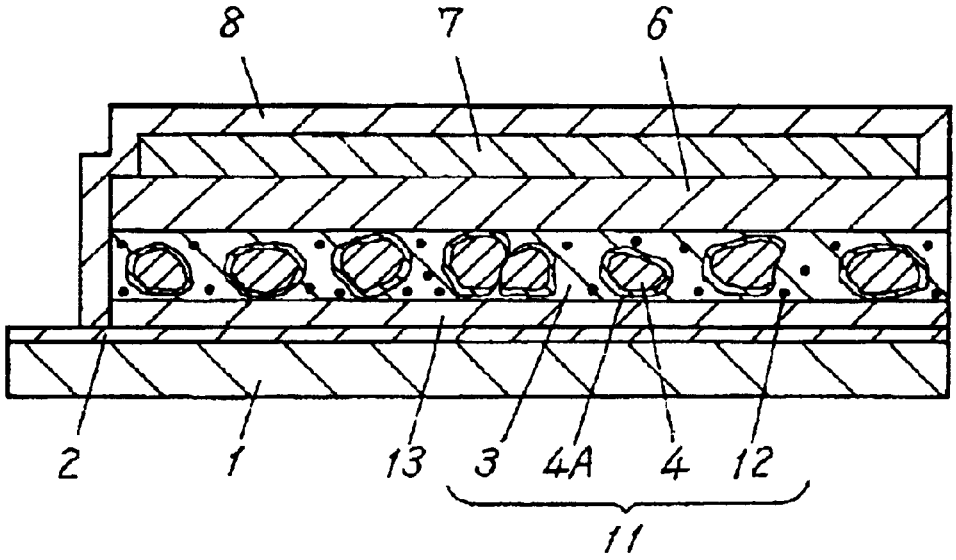
FIG. 1 shows a cross sectional view of an EL element in accordance with an exemplary embodiment of the present invention.
Figure 2:
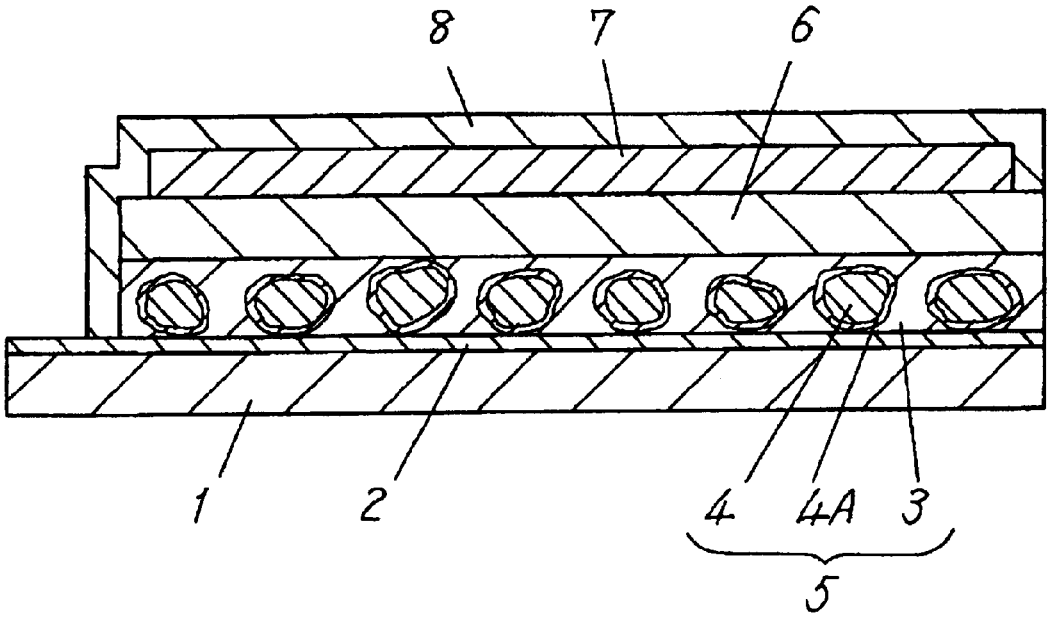
FIG. 2 Prior Art
FIG. 2 shows a cross sectional view of a conventional EL element.
Figure 3:
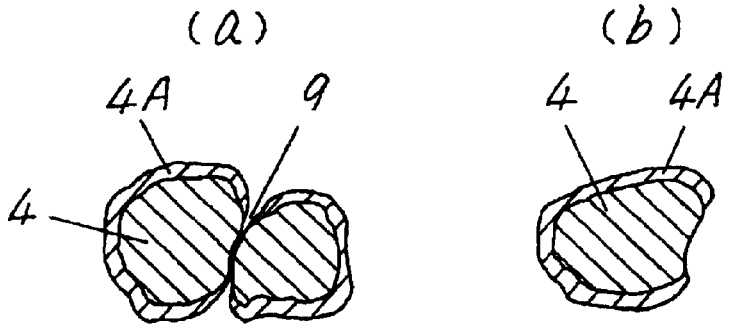
FIG. 3 Prior Art
FIGS. 3(*a*) and 3(*b*) show a partial cross sectional view of conventional phosphors.

FIG. 1 is a cross sectional view of an EL element in accordance with an exemplary embodiment of the present invention. The basic elements of the EL element include a light transmitting insulating film 1 made of polyethylene terephthalate, polyimide or the like, a light transmitting indium tin oxide electrode layer 2 formed by a sputtering process or an electron beam deposition process covering the whole area of the upper surface of the light transmitting insulating film 1, and a light emitting layer 11 made of a fluoro-carbon rubber or the like synthetic resin binder 3 containing a phosphor 4 of zinc sulfide or the like materials, which emits light, dispersed therein.

The phosphor 4 is covered with a moisture barrier layer 4A, which is formed of metal oxides such as aluminum oxide, titanium oxide, silicon dioxide or the like, or formed of aluminum nitride or the like materials. The light emitting layer 11 contains, in addition to the phosphor 4, a positive ion exchanger 12 such as an antimonic acid, phosphoric acid salts, silicic acid salts, zeolite or the like materials, dispersed therein.

The light transmitting dielectric insulation layer 13 is formed using a resin material such as a cyano resin derivatives or a cyano resin derivatives containing high dielectric constant inorganic particles having a dielectric constant higher than 100. The above resin material shall be insoluble with the synthetic resin binder forming the light emitting layer.

The dielectric insulation layer 13 in the present exemplary embodiment is provided by printing method between the light transmitting electrode layer 2 and the light emitting layer 11, for a thickness of 0.1–20 $\mu$m.

On the light emitting layer 11, a dielectric layer 6 formed of a high dielectric constant synthetic resin binder containing barium titanate or the like high dielectric constant inorganic filler dispersed therein, a back electrode layer 7 of silver/resin or a carbon/resin composite and an insulating layer 8 of epoxy resin, polyester resin or the like are further provided by a printing method one after another overlaid in this order. An EL element is thus structured.

An EL element of the above configuration mounted in an electronic appliance is driven by an AC voltage supplied to the light transmitting electrode layer 2 and the back electrode layer 7. AC voltage is supplied from a certain specific circuit of the electronic appliance (not shown). The phosphor 4 in the light emitting layer 5 emits light to illuminate a display panel, such as LCD or the like of the appliance from the backside of them.

Now in the following, a method of manufacturing the EL elements is described. Characteristics of the EL element are also described.

On a 125 $\mu$m thick insulating film 1 of polyethylene terephthalate (PET), a 30 nm thick indium tin oxide layer is formed by a sputtering process to form a light transmitting electrode layer 2. And, other layers are stacked thereon one after another by a printing method as follows:

(1) On the light transmitting electrode layer 2, a 1.6 $\mu$m thick dielectric insulation layer 13 is formed by printing a cyanoethyl pluran resin ("CR-M" by Shin-etsu Chemical Industries Co. Ltd) paste dissolved in N-methyl pyrrolidone for a 30% solid content, using a 350 mesh stainless steel screen mask, and then drying it at 100° C. for 30 min.

Besides the above, other samples were manufactured for 10 different layer thickness with respect to the dielectric insulation layer 13, by varying the solid content of the cyanoethyl pluran resin, mesh number of the screen, and repeating times of the printing process (samples No. 1–No. 10 in Table 1).

(2) On the dielectric insulation layer 13, a synthetic resin binder paste dissolved in 2-ethoxy-ethoxy-ethanol is printed, and dried at 100° C. for 30 min. to form a light emitting layer 11. The paste includes 100 parts of fluoro-carbon rubber ("Byton" by du'Pont), 30 parts of antimony pentoxide hydrate powder (as the positive ion exchanger 12), which are dispersed by a roll mill. And a 50 g of the dispersion and a 200 g of the phosphor 4 covered with an aluminum nitride moisture barrier layer 4A ("ANE430" by Osrum Sylvania) are mixed and agitated together. The paste is screen printed using a patterned 200 mesh stainless steel screen mask.

Besides the above-described paste, other samples were manufactured also with respect to the light emitting layer 11 varying the weight % of positive ion exchanger 12 (sample No. 5 and No. 11 through No. 19 in Table 2).

(3) On the light emitting layer 11, a dielectric layer 6 is formed by printing a dielectric paste using a patterned 100 mesh stainless steel screen mask, and drying it in the same conditions as the light emitting layer 11. The dielectric paste is manufactured with a 22 parts of fluoro-carbon rubber ("Byton A" by E.I. du'Pont) dissolved in 2-ethoxy-ethoxy-ethanol, and a 78 parts of barium titanate powder ("BT-05" by Sakai Chemical), as a high dielectric constant inorganic filler, dispersed therein.

(4) On the dielectric layer 6, a back electrode layer 7 is formed by printing a carbon paste ("DW-250H" by Toyobo) using a patterned 200 mesh stainless steel screen mask, and drying it at 155° C. for 30 min.

(5) Finally, an insulating resist ("XB-804" by Fujikura Kasei Co. Ltd) is printed using a patterned 200 mesh stainless steel screen mask, and it is dried at 155° C. for 30 min. to form an insulating layer 8.

The sample EL elements No. 1–No. 10 thus manufactured were evaluated with respect to the items shown in Table 1.

The initial brightness (Cd/m$^2$) was measured by lighting the samples by applying a voltage of 100 V, 400 Hz, after they had been put on shelf for one day after they had prepared.

The brightness maintenance rate was calculated by measuring the brightness after 1000 hours of continuous lighting by 100 V, 400 Hz in a 25° C., 65% RH humidity chamber, the brightness was measured 30 minutes after the samples were taken out of the chamber, and comparing the values with the initial values.

The dark spot was evaluated by a visual inspection based on the criteria below: G (no dark spot), F (only a slight dark spot), P (dark spot appears as an unevenness), B (dark spots covers whole surface making an unevenness).

TABLE 1

| No. | Dielectric insulation layer ($\mu$m) | Ion exchanger added (wt %) | Initial brightness (Cd/m$^2$) | Brightness maintenance rate (%) | Dark spot evaluation |
|---|---|---|---|---|---|
| 1 | 0 | 30 | 96.5 | 38 | B |
| 2 | 0.06 | 30 | 96.6 | 39 | B |
| 3 | 0.18 | 30 | 97.1 | 42 | P |
| 4 | 0.8 | 30 | 96.2 | 51 | F |
| 5 | 1.6 | 30 | 95.5 | 54 | G |
| 6 | 2.8 | 30 | 94.8 | 54 | G |
| 7 | 5.2 | 30 | 91.5 | 56 | G |
| 8 | 12.6 | 30 | 81.2 | 61 | G |
| 9 | 16.3 | 30 | 68.1 | 63 | G |
| 10 | 28.1 | 30 | 32.1 | 71 | G |

As Table 1 shows, when compared with sample No. 1 which has no dielectric insulation layer 13 and sample No. 2 which has a dielectric insulation layer thinner than 0.1 $\mu$m, samples having the thicker dielectric insulation layer 13 exhibit the better evaluation in dark spot and the higher brightness maintenance rate, or the less brightness decrease.

However, with the increasing layer thickness in dielectric insulation layer 13, the initial brightness gradually decreases. In the sample No. 10 where the layer thickness exceeds 20 μm, the initial brightness lowers to approximately ⅓ of the other samples.

The EL element sample No. 5 and the samples No. 11 through No. 19 underwent a similar comparative evaluation; the initial brightness (Cd/m$^2$) by 100 V, 400 Hz was compared to the brightness after a 240 H continuous lighting by 100 V, 400 Hz in a 40° C., 95% RH humidity chamber for calculating the brightness maintenance rate, and the black spot was evaluated by a visual inspection based on criteria as follows: G (no black spot), F (a small number of black spots not greater than 1 mm ϕ), P (medium number of black spots not greater than 1 mm ϕ), B (black spot greater than 1 mm ϕ, or a substantial number of black spots not greater than 1 mm ϕ).

The results are shown in Table 2.

TABLE 2

| No. | Dielectric insulation layer (μm) | Ion exchanger added (wt %) | Initial brightness (Cd/m$^2$) | Brightness maintenance rate (%) | Black spot evaluation |
|---|---|---|---|---|---|
| 11 | 1.6 | 0 | 84.1 | 29 | B |
| 12 | 1.6 | 0.01 | 83.9 | 32 | B |
| 13 | 1.6 | 0.1 | 84.5 | 36 | B |
| 14 | 1.6 | 1 | 84.8 | 49 | P |
| 15 | 1.6 | 10 | 89.2 | 68 | F |
| 5 | 1.6 | 30 | 95.5 | 72 | G |
| 16 | 1.6 | 100 | 96.9 | 72 | G |
| 17 | 1.6 | 200 | 98.3 | 72 | G |
| 18 | 1.6 | 300 | 98.6 | 71 | G |
| 19 | 1.6 | 400 | 93.0 | 73 | G |

As Table 2 shows, with the dielectric insulation layer 13 with a certain fixed layer thickness, the brightness maintenance rate goes high along with the increasing quantity of positive ion exchanger 12 added in the light emitting layer 11; also the black spot problems improve.

As described above, if the light emitting layer 11 includes positive ion exchanger 12 and a dielectric insulation layer 13 is provided between the light transmitting electrode layer 2 and the light emitting layer 11 in accordance with the present embodiment, the EL elements exhibit an improved illuminating performance, in which an occurrence of the dark spot is suppressed, in addition to a suppression of the black spot.

Furthermore, if a dielectric insulation layer 13 is formed with a cyano resin derivatives or a cyano resin derivatives including a high dielectric constant inorganic particle having a dielectric constant of higher than 100, the dielectric insulation layer 13 becomes to have high dielectric constant, and the applied voltage is concentrated to the low dielectric constant light emitting layer 11. As a result, a high brightness EL element can be obtained.

Furthermore, when the layer thickness of the dielectric insulation layer 13 is controlled to be within a range of 0.1–20 μm, occurrence of the dark spot can be prevented, and the brightness decrease can also be suppressed.

Although in the above descriptions cyanoethyl pluran resin was used as an example of synthetic resin for the dielectric insulation layer 13, cyanoethyl cellulose, or cyano saccharose and the like polysaccharide synthetic resin may of course be used instead for making an EL element of the present invention.

These cyano resin containing a high dielectric constant inorganic particle having a dielectric constant of higher than 100, for example, such as titanium oxide having a dielectric constant of 300, barium titanate having a dielectric constant of 300, barium titaniate zirconate having a dielectric constant of 6000 can be used for the same purpose.

In the above descriptions, antimony pentoxide hydrate powder (antimonic acid) was used as an example for the positive ion exchanger 12 included in the light emitting layer 11. However, other positive ion exchanger such as titanium phosphate or the like phosphoric acid salts, a silicic acid salts, zeolite, or "IXE-100-400" by Toa-Gosei Co. Ltd. may of course be used instead. Namely, any compound or mixture, regardless of inorganic or organic, that has the positive ion exchange function can be used for the same effects.

In the above descriptions, Osrum Sylvania's "ANE430" provided with an aluminum nitride moisture barrier layer 4A was used as an example for the phosphor 4 of the light emitting layer 11. However, other phosphor covered with metal oxides such as aluminum oxide, titanium oxide, silicon dioxide or the like, for example, Osrum Sylvania's CJ type, or other phosphor without having a moisture barrier layer 4A, for example Osrum Sylvania's #723 may also be used instead for the same purpose.

Although a fluoro-carbon rubber was used as an example for the synthetic resin binder 3 of the light emitting layer 11 in the above descriptions, other synthetic resin binders such as a polyester system, a phenoxy resin, an epoxy resin, an acrylic resin may also be used instead for the same purpose.

As described above, the present invention provides an EL element having an improved illuminating performance, where occurrence of the dark spot is suppressed, in addition to the suppression of the occurrence of the black spot.

What is claimed is:

1. An EL element comprising:

a light transmitting substrate;

a light transmitting electrode layer formed on said substrate;

a light emitting layer formed on said electrode layer and containing a positive ion exchanger;

a dielectric layer formed on said light emitting layer;

a back electrode layer formed on said dielectric layer; and a dielectric insulation layer disposed between said light transmitting electrode layer and said light emitting layer, said dielectric insulation layer being formed of a synthetic resin insoluble with a synthetic resin binder forming said light emitting layer.

2. The EL element of claim 1, wherein said dielectric insulation layer is formed of a cyano resin derivative, or a cyano resin derivative containing a high dielectric inorganic particle having a dielectric constant of higher than 100.

3. The EL element of claim 1, wherein a thickness of said dielectric insulation layer is 0.1–20 μm.

4. The EL element of claim 1, wherein said substrate is a resin film.

5. The EL element of claim 1, wherein said positive ion exchanger is an inorganic positive ion exchanger.

* * * * *